United States Patent [19]

Miller

[11] Patent Number: 5,044,601

[45] Date of Patent: Sep. 3, 1991

[54] OUTSIDE BAY ADAPTER FOR A CONCRETE FORMING SYSTEM

[75] Inventor: Michael J. Miller, Medinah, Ill.

[73] Assignee: Symons Corporation, Des Plaines, Ill.

[21] Appl. No.: 357,804

[22] Filed: May 30, 1989

[51] Int. Cl.[5] ..... E04G 17/04

[52] U.S. Cl. ..... 249/194; 249/47; 249/166; 249/210; 249/219.1

[58] Field of Search ..... 249/1, 13, 18, 33, 44, 249/47, 48, 50, 51, 166, 189, 192–194, 196, 210, 219.1

[56] References Cited

U.S. PATENT DOCUMENTS

| | | | |
|---|---|---|---|
| 2,976,597 | 3/1961 | Elam | 249/47 |
| 3,182,374 | 5/1965 | Cook | 249/20 |
| 3,917,216 | 11/1975 | Plough | 249/48 |
| 4,003,543 | 1/1977 | Doubleday et al. | 249/48 |

FOREIGN PATENT DOCUMENTS

| | | | |
|---|---|---|---|
| 215537 | 10/1956 | Australia | 249/196 |
| 2142467 | 3/1973 | Fed. Rep. of Germany | 249/48 |
| 2919468 | 11/1980 | Fed. Rep. of Germany | 249/194 |
| 678718 | 4/1930 | France | 249/196 |

*Primary Examiner*—James C. Housel
*Attorney, Agent, or Firm*—Charles F. Meroni, Jr.

[57] ABSTRACT

An outside bay adapter for a concrete forming structure. The adapter has a pair of elongated flat plates each of substantial length as compared to its width thereof. The plates are disposed in angular V-shaped relation to one another. The plates have a pair of confronting slots. The slots on the plates are transversely aligned with one another. Slotted wedge bolts are extended through the aligned slots and extend outwardly in diverging relation to one another adjacent opposite ends of the plates. A weldment is located at each end of the plates welding the slotted wedge bolts extended through the slots to the plates in unitary assembly together.

26 Claims, 7 Drawing Sheets

OUTSIDE BAY ADAPTER FOR A CONCRETE FORMING SYSTEM

Field of the Invention

The present invention relates to new and improved concrete forming structures or systems. More particularly, the structures or systems include one or more outside bay adapters which embody important features of my invention. The outside bay adapter has been developed for the purpose of enabling angled corners to be more quickly formed for a residential concrete form structure at lower costs. The concrete form structures may be of the aluminum or steel type as is wellknown in the industry. The outside bay adapter that embodies important features of my invention has been developed to enable rigid corners to be made using standard fillers rather than having to maintain an inventory of different sized fillers as previously required. My new outside bay adapter permits concrete walls of different heights to be built with only one type of outside bay adapter with all adapters having the same length regardless of the height of the wall to be formed. Further, by using my new outside bay adapter it is no longer necessary to maintain an inventory of different sized outside bay corners whether the adapter is used for an aluminum or steel concrete forming system or structure. While the adapters may have a length of 2" to 14" the preferred length is 2". It will further be observed that the outside bay adapter can be quickly assembled by extending its wedge bolts through slots in margins of filler panels so that the wedge bolts can then be pinned in place to secure the outside bay adapter in unitary relation with a pair of filler panels at opposite margins of the outside bay adapter in a quick and efficient manner.

DESCRIPTION OF PRIOR ART

In the past, where residential concrete forming structures had been used, it has been common practice to use inside bay corners and outside bay corners for forming corners of 135°. According to the present invention, the inside bay corner construction will remain the same as used in the past and this invention is particularly concerned with outside bay adapters which are to replace outside bay corners of the type illustrated in FIGS. 1-4 in the patent drawings attached hereto. It will be further understood that since residential concrete walls are built having different vertical dimensions, manufacturers and concrete contractors have been maintaining inventories of outside bay corners of different vertical dimensions. With the new outside bay adapter disclosed herein, it will no longer be necessary to inventory outside bay corner panels of varying heights or to inventory them at all as this component will now be obsolete and no longer necessary in this type of construction work whereby a cost savings can be effected which will not only benefit the contractor but also the ultimate consumer by lowering the costs for building residential concrete walls of the type where forms of this character have been used previously.

SUMMARY OF MY INVENTION

The present invention relates to an outside bay adapter for a residential concrete forming structure comprising a pair of in each instance flat plates each of substantial length as compared to its width thereof, the plates being disposed in angular V-shaped relation to one another, the plates having a pair of slots, the slots on the plates being transversely aligned with one another, slotted wedge bolts being arranged in diverging relation to one another and extended through the aligned slots and extending outwardly, and a weldment welding the slotted wedge bolts extended through the slots t the plates in unitary assembly together.

In a concrete forming structure for forming concrete walls where the components thereof can be easily and quickly assembled on the job including a series of upright side-by-side positioned filler forming panels of the type having a face sheet and I-beams secured thereto at margins of the face with adjacent I-beams on adjacent panels co-acting to act as walers, the I-beams carrying vertically spaced slots, and with the panels being adapted to receive wedge bolts to be extended through aligned slots for securing the panels in assembly together, the improvement of outside bay adapters for spaced engagement with the I-beams for forming a corner between the side-by-side positioned forming panels, each adapter comprising pair of in each instance flat plates each of substantial length as compared to its width thereof, the plates being disposed in angular V-shaped relation to one another, the plates having a pair of slots associated in transversely aligned relation to one another, the plate slots on the plates at each end being transversely aligned with one another, slotted wedge bolts arranged in a common plane and extended through the aligned plate slots and extending outwardly in diverging relation to one another for projection through the slots in the I-beams to secure the adapter thereto to form the corner between the panels when positioned to form a corner, and a weldment welding the slotted wedge bolts extended through the plate slots to the plates in unitary assembly together.

The present invention further relates to an outside bay adapter for a residential concrete forming structure comprising a pair of elongated flat plates each of substantial length as compared to its width thereof, the plates being disposed in angular V-shaped relation to one another, each plate having a pair of slots at opposite ends of the plate associated therewith, the slots on the plates at each end being transversely aligned with one another, a pair of triangular plate members positioned in immediate adjacency to the transversely aligned slots at the opposite ends of the plate members, slotted wedge bolts arranged as diverging pairs and extended through the aligned slots and extending outwardly in diverging relation to one another adjacent opposite ends of the plates, and a weldment at each end of the plates welding the slotted wedge bolts extended through the slots to the plates and to the triangular plate members in unitary assembly together.

According to other features of my invention, the triangular plate members each have a corner angle of 45° positioned at a corner of the plates in angular V-shaped relation for enabling the adapter and its flat plates to be positioned for joining concrete form members in 135° relation to one another.

Still other features of my invention relate to the slotted wedge bolts at each end of the plates being welded in head-to-head abutment in transverse aligned assembly together and lying in a common plane extended at right angles to the associated pair of flat plates.

Yet other features of my invention relate to the slotted wedge bolts being bias cut and engaged along a line which intersects an inner corner of said flat plates where the wedge bolts are engaged in head-to-head welded abutment.

Still further features of my invention relate to the triangular plates each having a pointed end extending between the flat plates holding the flat plates apart and in spaced relationship to one another.

In a concrete forming structure for forming concrete walls where the components thereof can be easily and quickly assembled on the job including a series of upright side-by-side positioned filler forming panels of the type having a face sheet and I-beams secured thereto at margins of the face with adjacent I-beams on adjacent panels co-acting to act as walers, the I-beams carrying vertically spaced slots, and with the panels being adapted to receive wedge bolts to be extended through aligned slots for securing the panels in assembly together, the improvement of outside bay adapters for spaced engagement with the I-beams for forming a corner between the side-by-side positioned forming panels, each adapter comprising pair of elongated flat plates each of substantial length as compared to its width thereof, the plates being disposed in angular V-shaped relation to one another, said plates having a pair of slots associated in transversely aligned relation to one another, the plate slots on the plates at each end being transversely aligned with one another, slotted wedge bolts arranged in a common plane and extended through the aligned plate slots and extending outwardly in diverging relation to one another for projection through the slots in the I-beams to secure the adapter thereto to form the corner between the panels when positioned to form a corner, and a weldment welding the slotted wedge bolts extended through the plate slots to the plates in unitary assembly together.

BRIEF DESCRIPTION OF THE DRAWINGS

Other objects and features of the present invention will become more fully apparent in view of the following detailed description taken in conjunction with the accompanying drawings illustrating several preferred embodiments, as follows.

DESCRIPTION OF THE PREFERRED EMBODIMENTS

Figure 1:
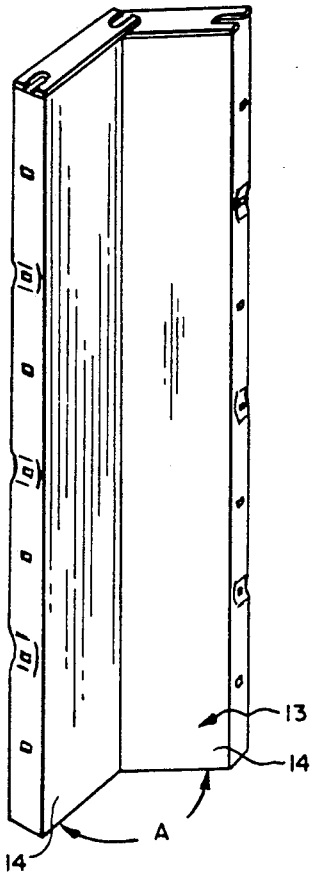
FIG. 1 PRIOR ART
FIG. 1 is a perspective view of a conventional outside bay corner.
Figure 2:
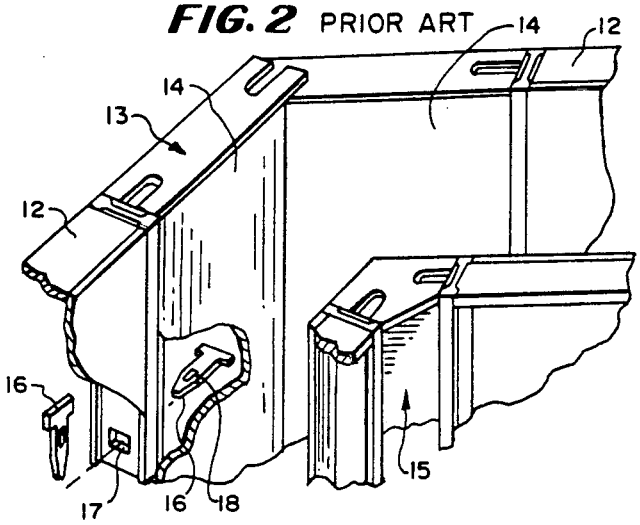
FIG. 2 PRIOR ART
FIG. 2 is an enlarged fragmentary exploded perspective view of the outside bay corner shown in FIG. 1 mounted as part of a concrete form structure.
Figure 3:
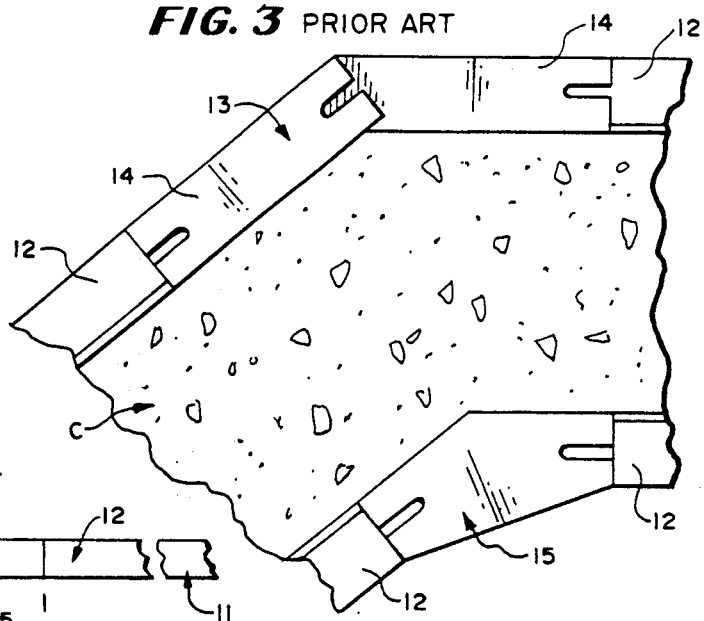
FIG. 3 PRIOR ART
FIG. 3 is a plan view of a concrete form structure using the conventional outside bay corner with concrete appearing in the form.
Figure 4:
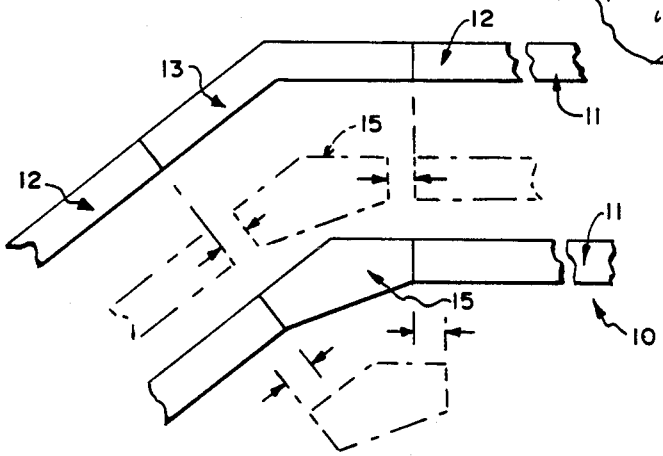
FIG. 4 PRIOR ART
FIG. 4 is an enlarged fragmentary diagramatic view illustrating a concrete form structure utilizing the outside bay corner known in the art.

The prior art concrete forming structure is indicated at 10 and is specifically shown in FIG. 4, and components of the structure of the prior art are also shown in FIGS. 1-3. To this end, the concrete forming structure 10 is adapted to form concrete C as is shown in FIG. 3 in a conventional manner. Inside and outside forms are used to entrap concrete between them. The concrete forming structure 10 particularly illustrates a structure that is adapted to form a concrete corner of 135°. The structure 10 includes upright side-by-side forming panels 11. Adjacent to the panels are a series of filler panels 12 which are located on opposite sides of an outside bay corner structure 13. The outside bay corner structure is comprised of a pair of corner panels 14, 14 (FIG. 1). Cooperable with the outside bay corner structure 13 is an inside bay corner 15. The outside bay corner structure 13 and the inside bay corner structure 15 are well-known in the art for forming angled wall corners of 135°.

It will be observed in FIG. 2 that the outside bay corner 13 is secured to the filler panel 12 by means of a pair of wedge bolts 16, 16, which are adapted to co-act with square shaped wedge bolt panel slots 17 to secure confronting margins of the panels 12 and 14 together in a conventional manner. These slots 17 are spaced in vertically spaced relation. To this end, the lefthand wedge bolt 16 is extended through a slot 18 in the other wedge bolt 16 after it has been extended through the slot 17 to lock the confronting panel margins of the panels 12 and 14 in rigid assembly together. Disassembly can be accomplished by reversing the procedure.

NEW OUTSIDE BAY ADAPTER

In accordance with my invention, I have developed a new outside bay adapter 20 as illustrated in FIGS. 5-9 inclusive. The outside bay adapter 20 is adapted to co-act with a concrete forming structure 19 in much the same way as the previously described outside bay corner 13 (FIGS. 1-4) that is known prior art.

Figure 7:
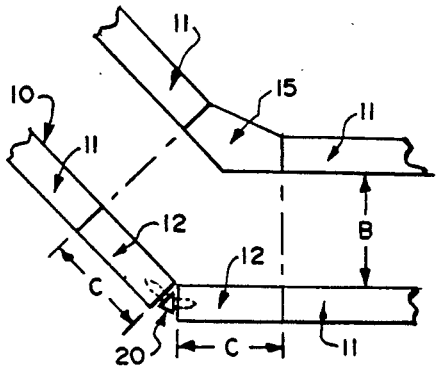
FIG. 7 is a diagramatic plan view of a concrete form structure with my new outside bay adapter as seen in FIG. 6.
Figure 8:
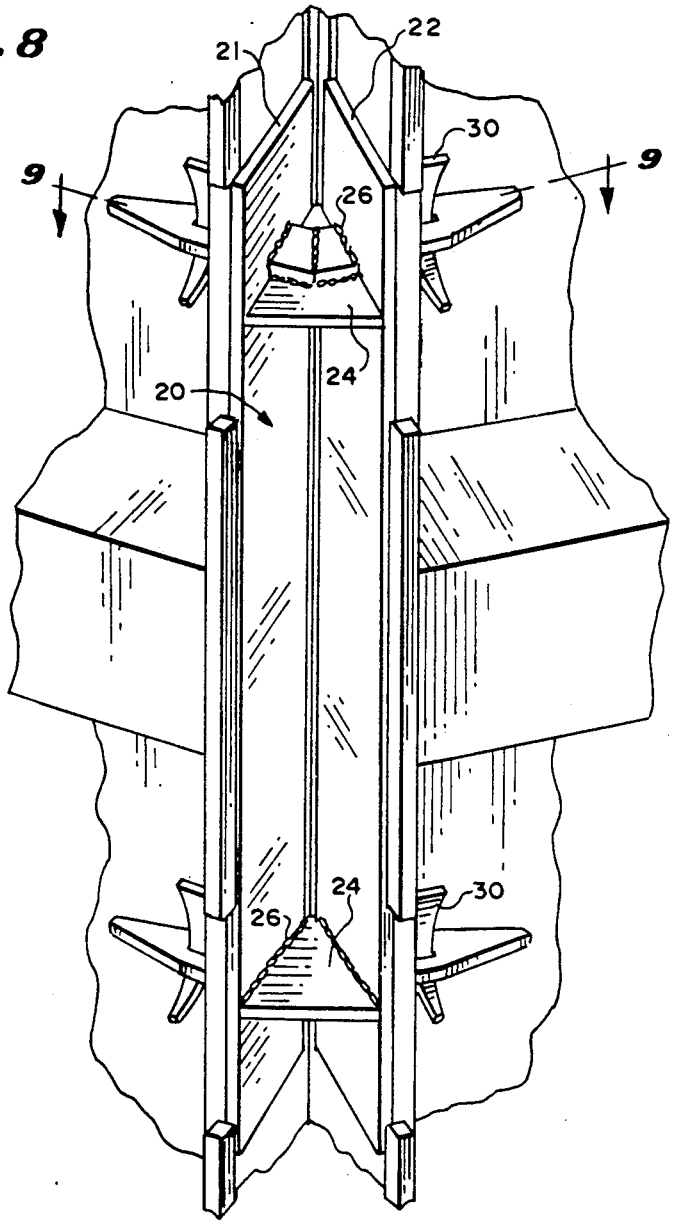
FIG. 8 is an enlarged fragmentary view of a concrete form structure similar to FIGS. 5 and 6 only showing the unit in assembled relationship.
Figure 9:
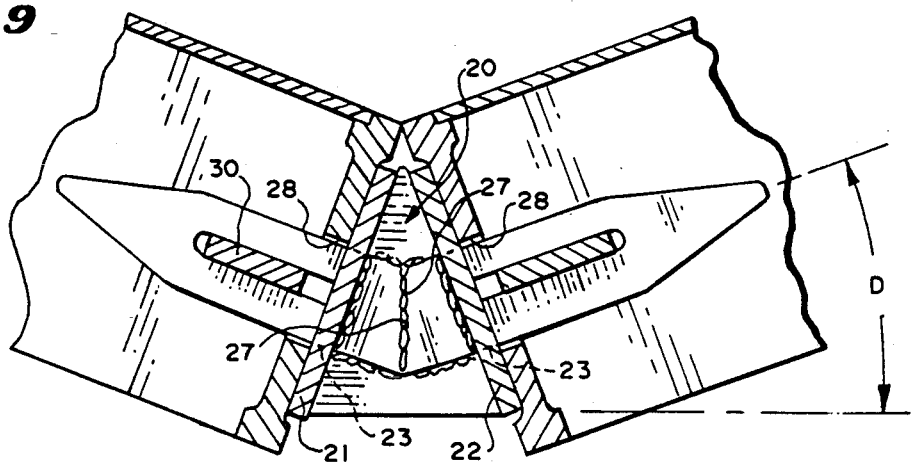
FIG. 9 is an enlarged cross sectional view taken on the line 9—9 looking in the direction indicated by the arrows as seen in FIG. 8.

The outside bay adapter 20 shown in FIGS. 5-9 is comprised of a pair of elongated flat plates 21 and 22. Each plate has a pair of plate slots 23, 23 (FIG. 9). The outside bay adapter 20 further is provided with a pair of triangular plate-like members 24, 24. Two pairs of slotted wedge bolts 25, 25 are oriented so that they are positioned in head-to-head or end-to-end welded assembly together and also in welded assembly with the associated triangular plate-like members 24, 24, the weldments being indicated generally at 26. As stated, the weldments 26 not only serve to secure the bolt shank ends of abutting faces or edges 27, 27 of the wedge bolts in welded assembly together, but they also serve to secure the bolt shank ends of the wedge bolts to the triangular plate-like member associated therewith. The weldments 26 are further extended and serve to secure the wedge bolts in welded assembly with the edges of the slots 23, 23 through which the wedge bolts are extended. The number 26 has thus been used to identify a series of welds generally identified herein as the weldments. It will be noted that heads or headed ends of the wedge bolts 25, 25 have been cut-off as contrasted to at least one embodiment hereafter described.

Figure 5:
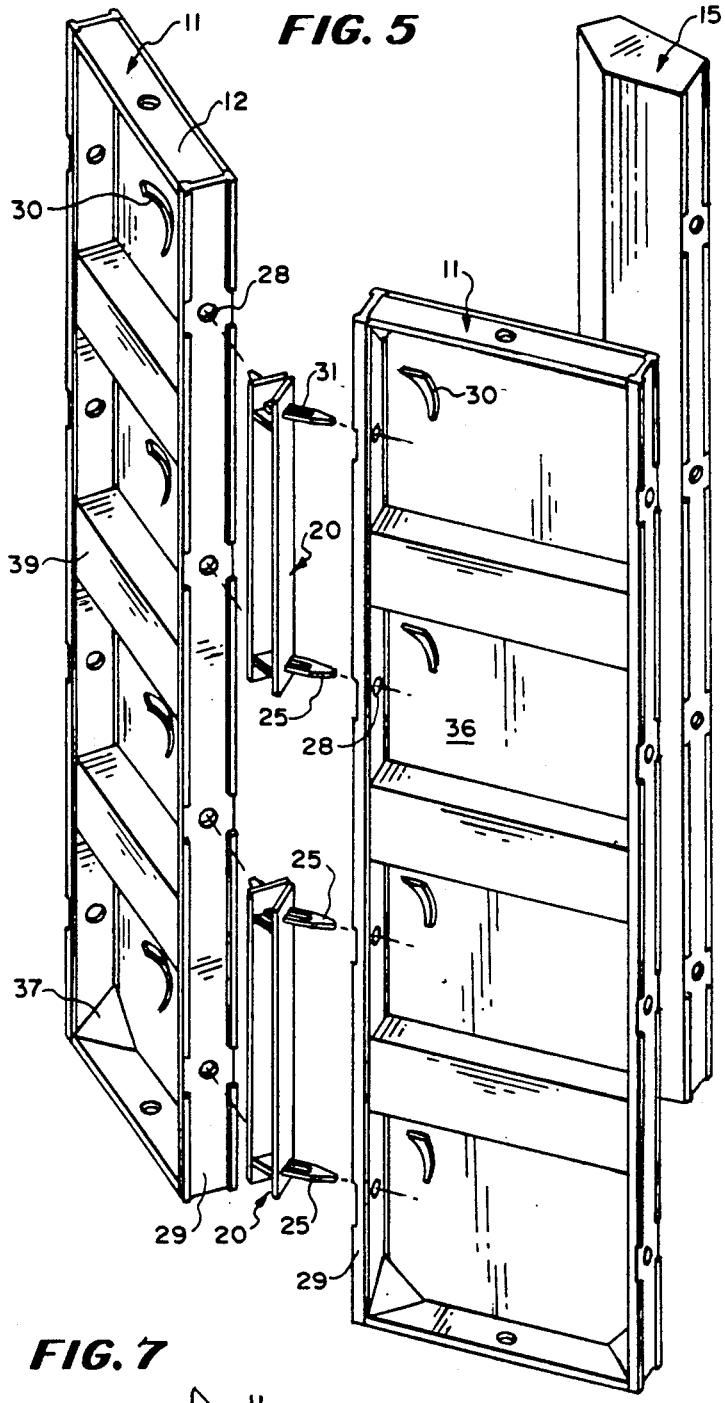
FIG. 5 is an exploded perspective view of a concrete form structure with my new outside bay adapter in accordance with my invention.
Figure 6:
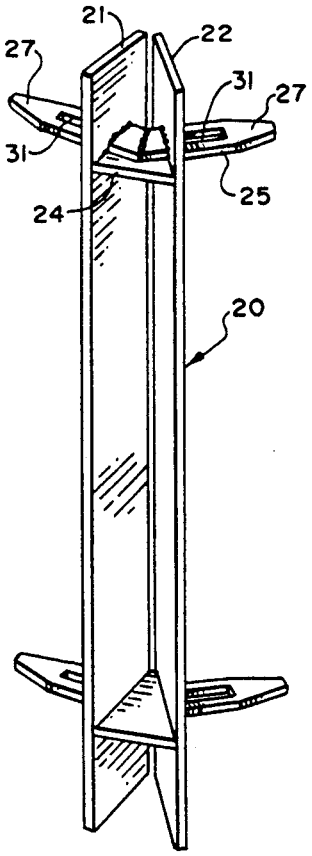
FIG. 6 is a perspective view of the adapter shown in FIG. 5.

Now in order to use the outside bay adapter 20, it is contemplated that the bay adapter be positioned between the pair of filler panels 11, 11 which also include I-shaped siderails as further described hereafter as shown diagramatically in FIG. 5. The slotted wedge bolts 25, 25 are aligned with circular wedge bolt openings 28 and extended through them as shown in FIG. 8. When the wedge bolts 25, 25 are extended through the openings 28 in I-shaped siderails 29 of the filler panel 11, the outside bay adapter 20 can be secured in retained assembly by extending curved wedge pins 30 through slots 31 in the wedge bolts 25, 25.

In view of the foregoing description, it will now be appreciated how I have provided a new outside bay adapter 20, which is particularly adapted for use with steel type concrete forms otherwise known in the trade as "STEEL PLY (a trademark applied to goods described as CONCRETE WALL FORMS) forming structures or systems. It will be further understood that in the illustrated embodiment that two adapters have been provided to connect adjoining filler panels 11 and 12. This number can be varied depending on the lengths of the adapters 20 and/or the length of the panels 11 and 12 that are to be connected. It is contemplated that in some instances only one adapter may be required to connect a given pair of filler panels 11.

From a study of FIG. 7, it will be seen that lead lines and reference letters are shown at B and C. In this regard, and in reference to FIG. 7, it will be understood that where the wall thickness is enlarged by enlarging the distance as indicated at B, the size of the filler 12 as denoted by the letter C will become wider.

Now it will be further understood from a consideration of FIG. 1 that the letter A denotes that the outside bay corner 13 has a 135 degree angle. Now in order to create this angle and to eliminate the outside bay corner structure 13, this result can be achieved by utilizing one of my new outside bay adapters such as are shown in the attached patent drawings and as has been previously indicated at 20 in FIG. 6. To this end, the plates 21 and 22 must be set at a predetermined angle relative to one another and this angle is 45 degrees. Now further, with reference to FIG. 9, it will be seen that the axis of the wedge bolt 25 must be set at an angle of 22.5 degrees relative to a horizontal line through bottom ends of the angled plates 21 and 22. By positioning the wedge bolts 25 at a 22.5 degree angle, they will then be in proper position to be extended through the siderails of the filler panels 11 and 12 that are to be joined together by the outside bay adapter 20.

Figure 10:
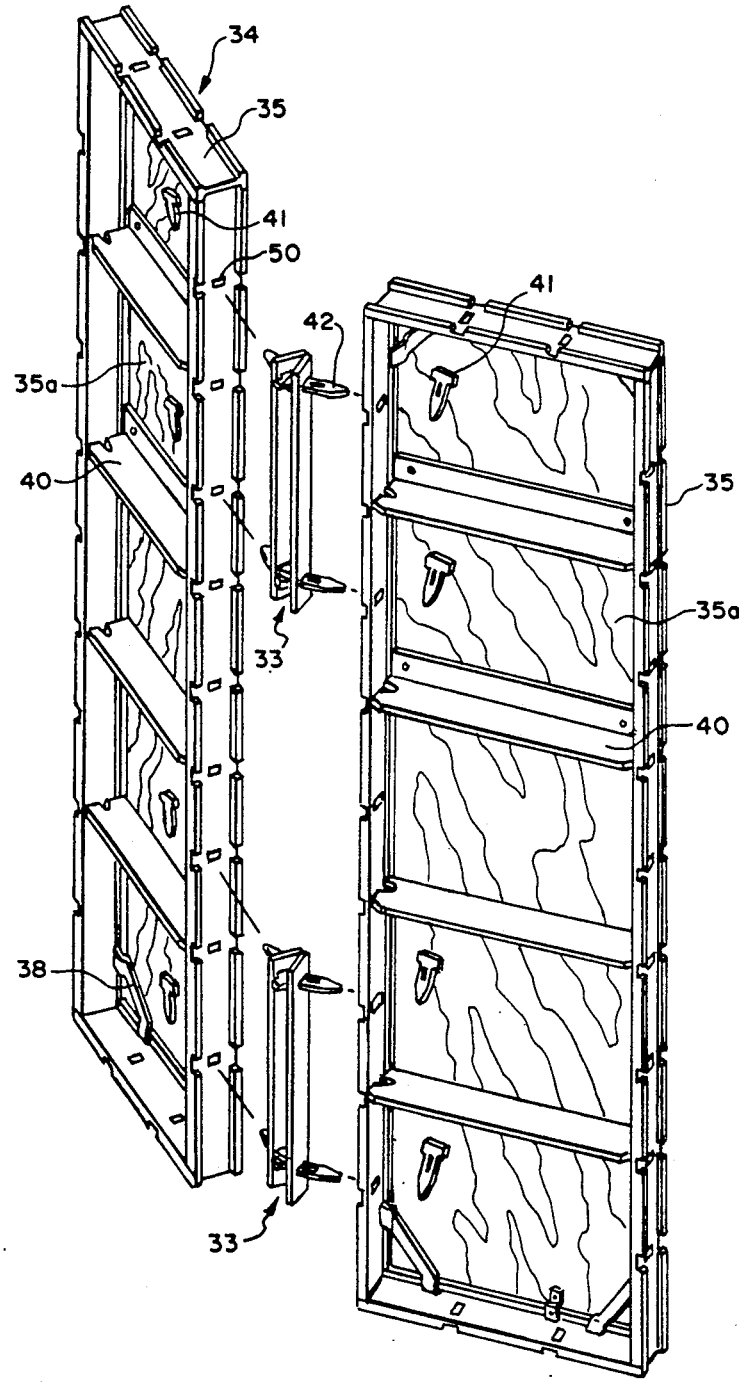
FIG. 10 is an enlarged exploded view showing a modified type of outside bay adapter also embodying features of my invention.
Figure 11:
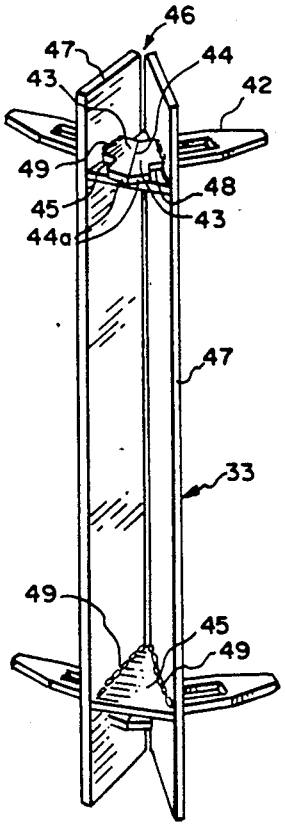
FIG. 11 is an enlarged perspective view of the modified type outside bay adapter shown in FIG. 10.

Now referring to FIGS. 10 and 11, I have provided an alternative type of outside bay corner indicated generally at 33. The outside bay corner 33 is for particular use with aluminum type of concrete forming structures as indicated generally at 34. The structure 34 is very similar to the structure 19 (FIG. 5), except the structure 34 has filler panels 35 that each require a wood face filler panel **35*a* instead of the steel face filler panel 36 (FIG. 5). It will be further appreciated that there are a few conventional details that differ in that the filler panels 12 that each has corner plates 37 (FIG. 5) for reinforcing the corners of the filler panels 12. The panels 35 on the concrete forming structure 34 use corner braces 38. The panels 35 on the concrete forming structure 19 use filler panels 39 and the concrete forming structure 34 uses L-shaped brace members 40 (FIG. 10**).

According to my invention and regarding the installation of my new Outside Bay Adapters, the panels 12 employ curved wedge pins 30 (FIG. 5) for securing the wedge bolts 25 in assembly with the filler panels 12. With my outside bay adapter 33, as shown in FIG. 10, I employ headed type wedge bolts 41 for securing the outside bay adapter 33 to the filler panels 35

The construction of the outside bay adapter 33 differs from the one previously described with reference to the way in which its headed wedge bolts 42 are formed. The wedge bolts 25 on the adapter 20 are headless since its heads have been removed. The wedge bolts 25 on the adapter 20 are provided with the confronting bias cut buttwise engaged edges or faces 27, 27. In contrast thereto, my adapter 33 has its wedge bolt heads 43 bias cut to provide butt engaging wedge bolt head edges or faces 44. As shown in FIG. 11, these butt engaged wedge bolt heads 43 overlap at outer head ends **44*a*, 44*a* underlying triangular plate-like members 45, 45 at points most remote to adapter corner 46 formed between angularly positioned flat plates 47, 47. The wedge bolt heads 43 and shanks 48 of the wedge bolts 42 are welded to the flat plates as well as to the triangular plates in unitary assembly by weldments 49** in the same way as previously described.

Figure 17:
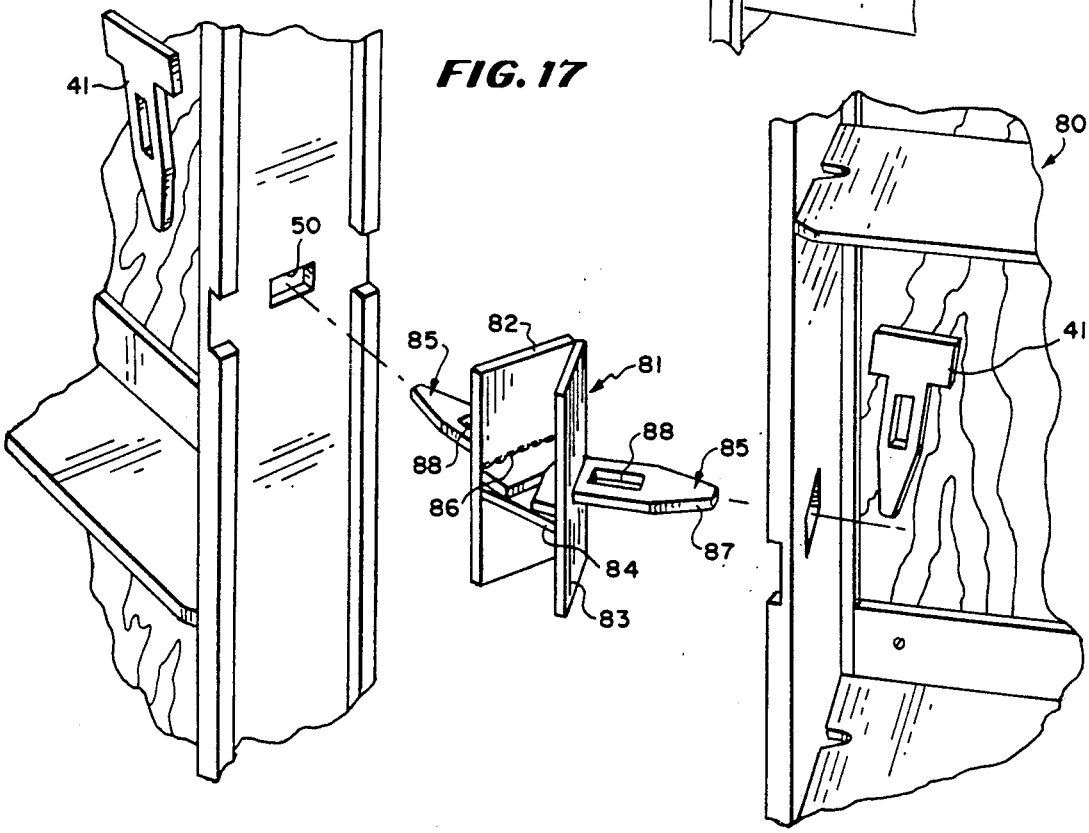
FIG. 17 is yet another outside bay adapter embodying important features of my invention.

When the wedge bolts 42 on the adapter 33 are to be assembled with the filler panels 35, the ends of the bolts are extended through square holes 50 in the vertical sides of the filler panels. Thereafter the wedge bolts 41 are inserted in the holes in the wedge bolts 42 to lock the adapter 46 in assembly with the filler panel as previously described. It will further be noted that the filler panels 35 are also identical to the ones shown in FIG. 17.

Figure 12:
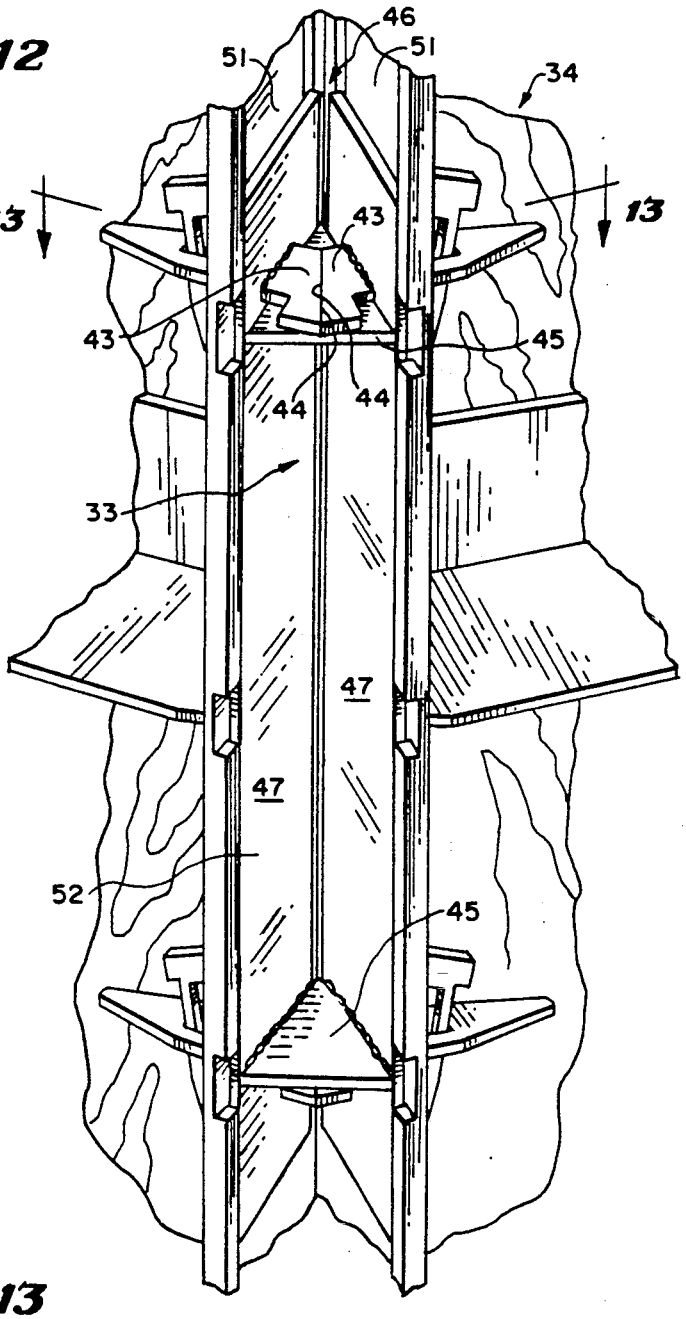
FIG. 12 is an enlarged fragmentary view of a concrete forming structure utilizing the outside bay adapter shown in FIG. 11.
Figure 13:
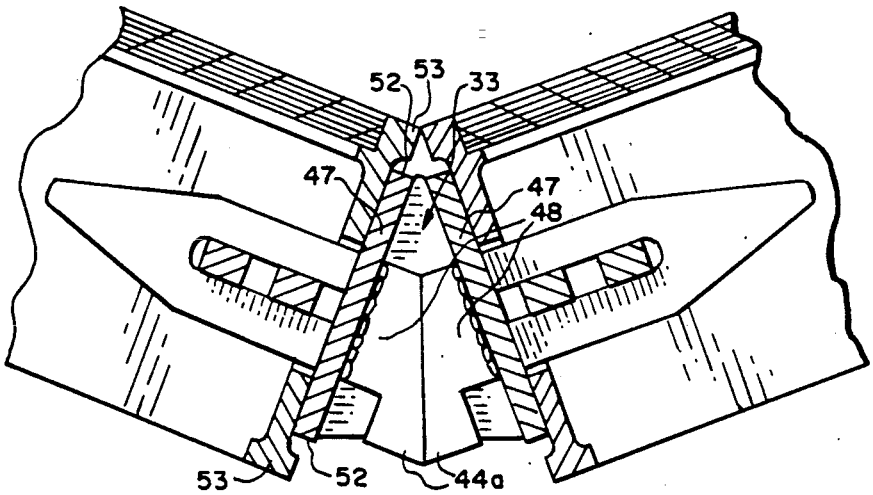
FIG. 13 is an enlarged cross sectional view taken on the line 13—13 looking into the direction indicated by the arrows as seen in FIG. 12.

Now in FIGS. 12 and 13, the outside bay adapter 33 is shown in assembled enlarged relation with the other components of the concrete forming structure of the same type previously described. Here it will be seen that the adapter 33 is nested inside I-shaped siderails 51, 51 with the flat plates 47, 47 of the adapter being positioned in spaced relation at opposite ends 52, 52 with respect to end stems 53, 53 of the I-shaped siderails 51, 51 as shown in FIGS. 12 and 13.

Figure 14:
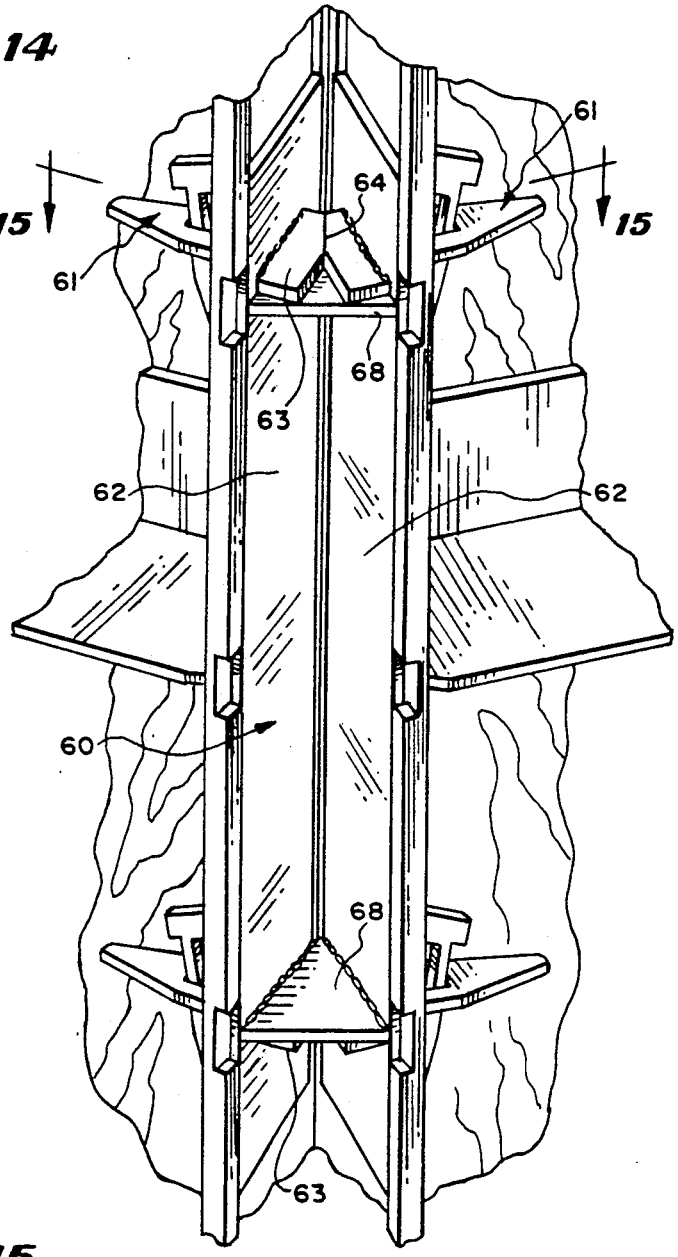
FIG. 14 is an enlarged fragmentary cross sectional view of a concrete forming structure with a further modified outside bay adapter.
Figure 15:
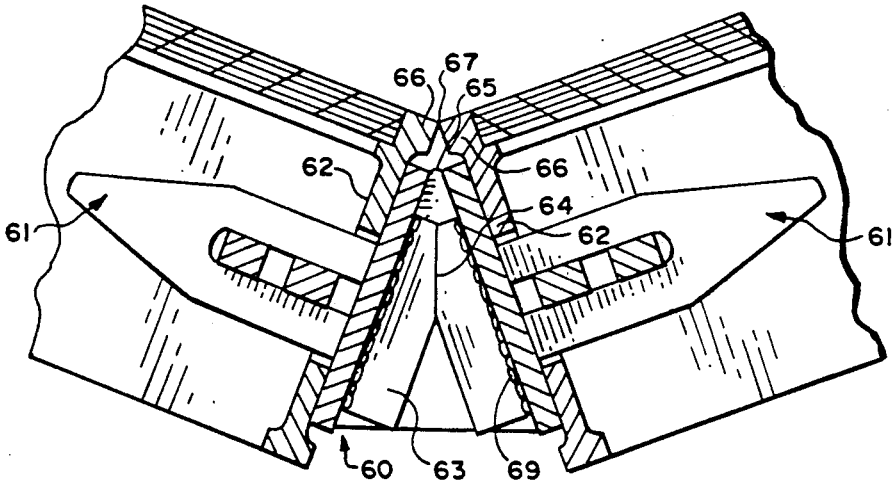
FIG. 15 is an enlarged vertical cross section taken on the line 15—15 looking in the direction indicated by the arrows as seen in FIG. 14 further illustrating a still further embodiment of my invention.

In FIGS. 14 and 15, I have provided still another type of outside bay adapter 60. In this instance, the adapter is provided with pairs of wedge bolts 61, 61 which are assembled in the same way with an associated pair of flat plates 62, 62 as previously described. The wedge bolts in this instance have heads 63, 63 which are bias cut to provide angled surfaces 64, 64 for edgewise end-to-end abutment engagement together which angled surfaces when butt engaged lie in a plane that intersects through an inside corner 65 of the outside bay adapter as well as a corner 66 of the filler panels on which the outside bay adapter is mounted, the inside corner 65 of the outside bay adapter being positioned in spaced relation to a point 67 where the filler panels are corner engaged as seen in FIG. 15. The heads 63, 63 are welded to the plates 62, 62 and to triangular plate-like members 68, 68 as indicated at 69. Now this particular embodiment is particularly advantageous for the bolt heads 63, 63 do not overlap the triangular plate-like members but lie within the frame work and outer edge structure of the triangular plate-like members so as to be more compact relative to the overall outside bay adapter 60.

Figure 16:
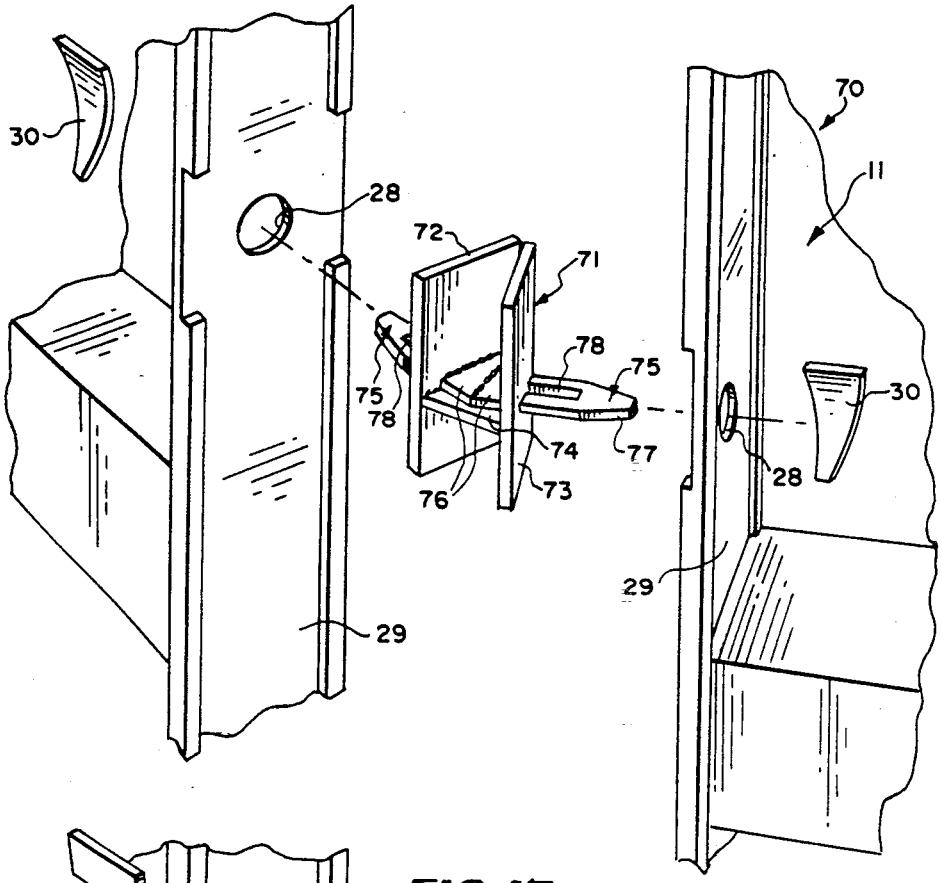
FIG. 16 is an enlarged exploded perspective view showing a further modified outside bay adapter embodying important features of my invention.

The reference numeral 70 indicates generally a modified type of concrete forming structure (FIG. 16) which is similar to the forming structure previously described except that the structure utilizes a modified type of outside bay corner or adapter as indicated at 71. The adapter 71 is comprised of a pair of flat plates 72 and 73 which are similar to the corresponding plates on the other adapters previously described. These plates are provided with a pair of slots (not shown) but which are similar to the slots 23, 23 as previously described. Positioned between the plates 72 and 73 is a triangular plate-like member 74. This plate-like member has a pair of slotted wedge bolts 75, 75 extended through the plate-like slots (not shown) as previously described. Weldments 76 are provided for securing the ends of the slotted wedge bolts 75, 75 together and to the edges of the plate slots (not shown) and to the adjacent surface of the triangular plate-like member 74 all a previously described.

One difference between the outside bay adapter 71 and the corresponding adapter 20 that has been previously discussed has to do with the length of the plates 72 and 73. In this instance, the plate 72 and 73 are only 2" in length whereas the plates 21 and 22 shown in FIG. 8 can be of the order of 8" or more. Another difference between the adapter 71 and the adapter 20 has to do with the fact that only one set of wedge bolts 75, 75 are joined with the plates 72 and 73 whereas with the embodiments of the outside bay adapter 20 previously described, at least two or more sets of wedge bolts were provided on each of the longer outside bay adapters. With the shorter outside bay adapter 20 only one pair of wedge bolts are needed.

It will be further seen that the outside bay adapter 71 can be mounted with the I-shaped siderails 29 in the same way as previously described. To this end, the wedge bolts 75 and more particularly the bevelled ends 77 of the wedge bolts are insertable through the round holes 28, 28 in the I-shaped siderails 29 and the wedge pins 30 are insertable through slots 78 in each of the wedge bolts in the same way as previously described.

The reference numeral 80 (FIG. 17) indicates generally a modified type of concrete forming structure which is similar to the forming structure previously described except that the structure utilizes a modified type of outside bay corner or adapter as indicated at 81. The adapter 81 is comprised of a pair of flat plates 82 and 83 which are similar to the corresponding plates on the other adapters previously described. These plates are provided with a pair of slots (not shown) but which are similar to the slots 23, 23 as previously described. Positioned between the plates 82 and 83 is a triangular plate-like member 84. This plate-like member has a pair of slotted wedge bolts 85, 85 extended through the plate slots (not shown) as previously described. Weldments 86 are provided for securing the ends of the slotted wedge bolts 85, 85 together and to the edges of the plate slots (not shown) and to the adjacent surface of the triangular plate-like member 84 all as previously described.

One difference between the outside bay adapter 81 and the corresponding adapter 20 has to do with the length of the plates 82 and 83. In this instance, the plate 82 and 83 are only 2" in length whereas the plates 21 and 22 shown in FIG. 8 can be of the order of 8" or more. Another difference between the adapter 81 and the adapter 20 has to do with the fact that only one set of wedge bolts 85, 85 are joined with the plates 82 and 83 whereas with the embodiments of the outside bay adapter previously described at least two or more sets of wedge bolts were provided on each of the longer outside bay adapters. With the shorter outside bay adapter, only one pair of wedge bolts are needed.

It will be further seen that the outside bay adapter 81 can be mounted with the I-shaped siderails 29 in the same way as previously described. To this end, the wedge bolts 85 and more particularly the bevelled ends 87 of the wedge bolts are insertable through the round holes 28, 28 in the I-shaped siderails 29 and the wedge pins 30 are insertable through slots 88 in each of the wedge bolts in the same way as previously described.

The waler bracket may be comprised of any suitable material, and excellent results are obtainable where they are manufactured with a hot rolled steel of a general purpose type. Excellent results can be attained by manufacturing the bolt from C-1040 type steel.

While several embodiments of the invention have been described, the invention is not limited to the details set forth and other embodiments and modifications may come within and extend from the following claims:

I claim:

1. An outside bay adapter for a residential concrete forming structure comprising a pair of elongated flat plates each of substantial length as compared to its width thereof, the plates being disposed in angular V-shaped relation to one another, said plates having a pair of slots, the slots on the plates being transversely aligned with one another, slotted wedge bolts being arranged in diverging relation to one another and extended through the aligned slots and extending outwardly, a weldment welding the slotted wedge bolts extended through the slots to the plates in unitary assembly together, and a triangular plate having a pointed end extending between the flat plates holding the flat plates apart and in spaced relationship to one another.

2. The adapter of claim 1 further defined by the slotted wedge bolts being welded in head-to-head abutment in transversely aligned assembly together, the welded wedge bolts lying in a common horizontal plane and extended at right angles to the associated pair of the flat plates.

3. The adapter of claim 2 further defined by the slotted wedge bolts being bias cut and engaged along a line which intersects an inner corner of said flat plates where the wedge bolts are engaged in head-to-head welding abutment.

4. The adapter of claim 1 further defined by said plates having a length in a range of 2" to 14".

5. The adapter of claim 1 further defined by the triangular plate having a corner angle of 45° positioned at a corner of the plates in angular V-shaped relation for enabling the adapter and its flat plates to be positioned for joining concrete form members in 135° relation to one another.

6. The outside bay adapter of claim 1 further defined by the wedge bolts having heads, the heads each having a beveled corner, the beveled corners being engaged in abutting engagement together and with said weldment holding the bevelled corners of the heads of the wedge bolts in abutment.

7. The outside bay adapter of claim 1 further defined by each of said wedge bolts having an enlarged flat sided head, the heads having their flat sides engaged against said triangular plate in abutting contact therewith.

8. The adapter of claim 1 further defined by the slotted wedge bolts being bias cut and engaged along a line which intersects an inner corner of said flat plates where the wedge bolts are engaged in head-to-head welded abutment, head ends of the engaged wedge bolts being supported by the triangular plate associated therewith and with the head ends being engaged along an entire width of the engaged bolts.

9. An outside bay adapter for a residential concrete forming structure comprising a pair of elongated flat plates each of substantial length as compared to its width thereof, the plates being disposed in angular V-shaped relation to one another, said plates having a pair of slots, the slots on the plates being transversely aligned with one another, slotted wedge bolts being arranged in diverging relation to one another and extended through the aligned slots and extending outwardly, a weldment welding the slotted wedge bolts extended through the slots to the plates in unitary assembly together, the flat plates having inner corner edges positioned in gap relation, and a triangular plate having a corner extended into said gap and cooperating with said weldment to maintain said gap in a predetermined relation to said inner corner edges of said flat plates.

10. The adapter of claim 9 further defined by the slotted wedge bolts being welded in head-to-head abutment in transverse aligned assembly together and lying in a common plane extended at right angles to the associated pair of the flat plates.

11. The adapter of claim 10 further defined by the slotted wedge bolts being bias cut and butt engaged at inner ends with the wedge bolts being engaged in head-to-head welded abutment.

12. The adapter of claim 9 further defined by the triangular plate having a corner angle of 45° positioned at a corner of the plates in angular V-shaped relation for enabling the adapter and its flat plates to be positioned for joining concrete form members in 135° relation to one another.

13. The adapter of claim 9 further defined by the slotted wedge bolts being welded in head-to-head abutment in transverse aligned assembly together and lying in a common plane extended at right angles to the associated pair of the flat plates.

14. The adapter of claim 9 further defined by the slotted wedge bolts being bias cut and engaged along a line which intersects an inner corner of said flat plates where the wedge bolts are engaged in head-to-head welded abutment.

15. An outside bay adapter for a residential concrete forming structure comprising a pair of elongated flat plates each of substantial length as compared to its width thereof, the plates being disposed in angular V-shaped relation to one another, each plate having a pair of slots at opposite ends of the plate associated therewith, the slots on the plates at each end being transversely aligned with one another, a pair of triangular plate members positioned in immediate adjacency to the transversely aligned slots at the opposite ends of the plate members, slotted wedge bolts arranged as diverging pairs and extended through the aligned slots and extending outwardly in diverging relation to one another adjacent opposite ends of the plates, and a weldment at each end of the plates welding the slotted wedge bolts extended through the slots to the plates and to the triangular plate members in unitary assembly together, the triangular plate members each having a pointed end extending between the flat plates holding the flat plates apart and in spaced relationship to one another.

16. The outside bay adapter of claim 15 further defined by the wedge bolts having heads, the heads each having a beveled corner, the beveled corners being engaged in abutting engagement together and with said weldment holding the bevelled corners of the heads of the wedge bolts in abutment.

17. The outside bay adapter of claim 15 further defined by each of said wedge bolts having an enlarged flat sided head, the heads having their flat sides engaged against one of said triangular plate members in abutting contact therewith.

18. The adapter of claim 15 further defined by the wedge bolts secured by the weldment together being headless, the plates having a length in a range of 2" to 14".

19. The adapter of claim 15 further defined by the slotted wedge bolts being bias cut and engaged along a line which intersects an inner corner of said flat plates where the wedge bolts are engaged in head-to-head welded abutment, head ends of the engaged wedge bolts being supported by the triangular plate member associated therewith and with the head ends being engaged along an entire width of the engaged bolts.

20. The adapter of claim 15 further defined by the slotted wedge bolts at each end of the plates being welded in head-to-head abutment in transverse aligned assembly together, the welded wedge bolts lying in parallel planes to one another and extended at right angles to the associated pair of the flat plates.

21. The adapter of claim 15 further defined by the slotted wedge bolts being bias cut and engaged along a line which intersects an inner corner of said flat plates where the wedge bolts are engaged in head-to-head welded abutment.

22. The structure of claim 21 further defined the slotted wedge bolts at each end of the plates being welded in head-to-head abutment in transverse aligned assembly together and lying in common plane extended at right angles to the associated pair of the flat plates.

23. The structure of claim 22 further defined by the slotted wedge bolts being bias cut and engaged along a line which intersects an inner corner of said flat plates where the wedge bolts are engaged in head-to-head welded abutment.

24. An outside bay adapter for a residential concrete forming structure comprising a pair of elongated flat plates each of substantial length as compared to its width thereof, the plates being disposed in angular V-shaped relation to one another, each plate having a pair of slots at opposite ends of the plate associated therewith, the slots on the plates at each end being transversely aligned with one another, a pair of triangular plate members positioned in immediate adjacency to the transversely aligned slots at the opposite ends of the plate members, slotted wedge bolts arranged as diverging pairs and extended through the aligned slots and extending outwardly in diverging relation to one another adjacent opposite ends of the plates, and a weldment at each end of the plates welding the slotted wedge bolts extended through the slots to the plates and to the triangular plate members in unitary assembly together, the flat plates having inner corner edges positioned in gap relation, the triangular plate members each having a corner extended into said gap and cooperating with said weldment to maintain said gap in a predetermined relation to said inner corner edges of said flat plates.

25. In a concrete forming structure for forming concrete walls where components thereof can be easily and quickly assembled on the job including a series of upright side-by-side positioned filler forming panels having a face sheet and I-beams secured thereto at margins of the face sheet with adjacent I-beams on adjacent panels co-acting to act as walers, the I-beams carrying vertically spaced slots, and with the panels being adapted to receive wedge bolts to be extended through aligned slots for securing the panels in assembly together, the improvement comprising outside bay adapters for spaced engagement with the I-beams for forming a corner between the side-by-side positioned forming panels, each adapter comprising a pair of elongated flat plates each of substantial length as compared to its width thereof, the plates being disposed in angular V-shaped relation to one another, each plate having a pair of plate slots at opposite ends of the plate associated therewith, the plate slots on the plates at each end being transversely aligned with one another, a pair of triangular plate members positioned in immediate adjacency to the transversely aligned plate slots at the opposite ends of the plates, slotted wedge bolts arranged as diverging pairs and extended through the aligned plate slots and extending outwardly in diverging relation to one another adjacent opposite ends of the plates for projection through the slots in the I-beams to secure the adapter thereto to form the corner between the panels when positioned to form a corner, and a weldment at each end of the plates welding the slotted wedge bolts extended through the plate slots to the plates and to the triangular plate members in unitary assembly together, the triangular plate members each having a pointed end extending between the flat plates holding the flat plates apart and in spaced relationship to one another.

26. The structure of claim 25 further defined by the triangular plate members each having a corner angle of 45° positioned at a corner of the plates in angular V-shaped relation for enabling the adapter and its flat plates to be positioned for joining the concrete form members in 135° relation to one another.

* * * * *